United States Patent [19]

O'Brien

[11] Patent Number: 5,025,503

[45] Date of Patent: Jun. 25, 1991

[54] GLOVE

[76] Inventor: Gwendolyn I. O'Brien, 6011 Mercedes, Dallas, Tex. 75206

[21] Appl. No.: 566

[22] Filed: Jan. 5, 1987

[51] Int. Cl.[5] ..... A41D 19/00; B65D 85/18

[52] U.S. Cl. ..... 2/163; 2/169; 2/243 B; 206/390

[58] Field of Search ..... 2/158, 159, 169, 167, 2/243 B; 206/390, 278

[56] References Cited

U.S. PATENT DOCUMENTS

| | | | |
|---|---|---|---|
| 3,229,875 | 1/1966 | Stoller | 2/169 X |
| 3,710,396 | 1/1973 | Tomlinson | 206/390 X |
| 4,034,853 | 7/1977 | Smith | 206/278 |
| 4,076,121 | 2/1978 | Clayton et al. | 206/390 |
| 4,677,697 | 7/1987 | Hayes | 2/159 |

FOREIGN PATENT DOCUMENTS

| | | | |
|---|---|---|---|
| 267184 | 12/1964 | Australia | 206/390 |

*Primary Examiner*—Werner H. Schroeder

*Attorney, Agent, or Firm*—Richards, Medlock & Andrews

[57] ABSTRACT

An improved glove (10) is disclosed which forms part of a continuous roll of gloves (12) which is particularly suitable for use with a dispensing machine (28). The machine dispenses one or a pair of the gloves (10) off the roll (12) for use by an individual at a gas station or vegetable section of a grocery store, or the like.

4 Claims, 1 Drawing Sheet

10
12
14
16
18
20
22
24
26
28
30
31
32
34
36
38
40
42
44
46
48
50
52
54
56
58

GLOVE

TECHNICAL FIELD

This invention relates to an improved glove, and in particular to a glove adapted to form part of a continuous roll of gloves for dispensing.

BACKGROUND OF THE INVENTION

In recent years, filling stations have moved almost solely to a self-serve format. Of course, this requires an occupant of the car to operate the gasoline pump. Quite often, the user's hand comes in contact with the gasoline. With so few stations having adequate washing facilities, the user must often drive off to work or home reeking of gasoline.

It has been suggested to provide gloves at the gasoline pumps for wearing by a user to reduce this problem. However, it has so far proven impractical. If gloves are placed by the pumps for taking by a user, people abuse the service by stealing gloves. If the station owner controls the distribution of the gloves, it becomes a time consuming and frustrating effort. A need therefore exists to resolve these problems in the marketplace.

SUMMARY OF THE INVENTION

In accordance with a first aspect of the present invention, a glove is provided which has a first side and a second side. The glove sides are joined along parallel edges and at a first end. The sides are separate at the opposite end to permit a hand to be inserted within the glove. The glove is particularly suited for being part of a roll of gloves secured end to end for distribution from a dispensing device.

In accordance with other aspects of the present invention, the glove can be split along a line parallel to and proximate a first edge from the first end with the first and second sides being joined on either side of the split for a sufficient distance to form a thumb portion. The glove can further be split along lines parallel the edges from the first end, again with the first and second sides being joined on either side of the splits, for a sufficient distance to form individual finger portions. In addition, the first end of the glove can include thumb and little finger tip portions extending inward from the edges of the glove, with finger side portions extending parallel the edges from the inner end of the thumb and little finger tip portions away from the open end of the glove to a finger tip portion extending between the finger side portions to more accurately fit the glove to the hand.

In accordance with another aspect of the present invention, a roll of gloves such as described above is provided, on which the gloves are removably secured at their ends to form a continuous roll. A dispensing machine can be used to dispense a number of gloves upon insertion of money or the like to control dispensing of the gloves.

BRIEF DESCRIPTION OF THE DRAWINGS

With reference now to the following Detailed Description, taken in conjunction with the accompanying Drawings, wherein.

DETAILED DESCRIPTION

Figures 1, 2, 3:
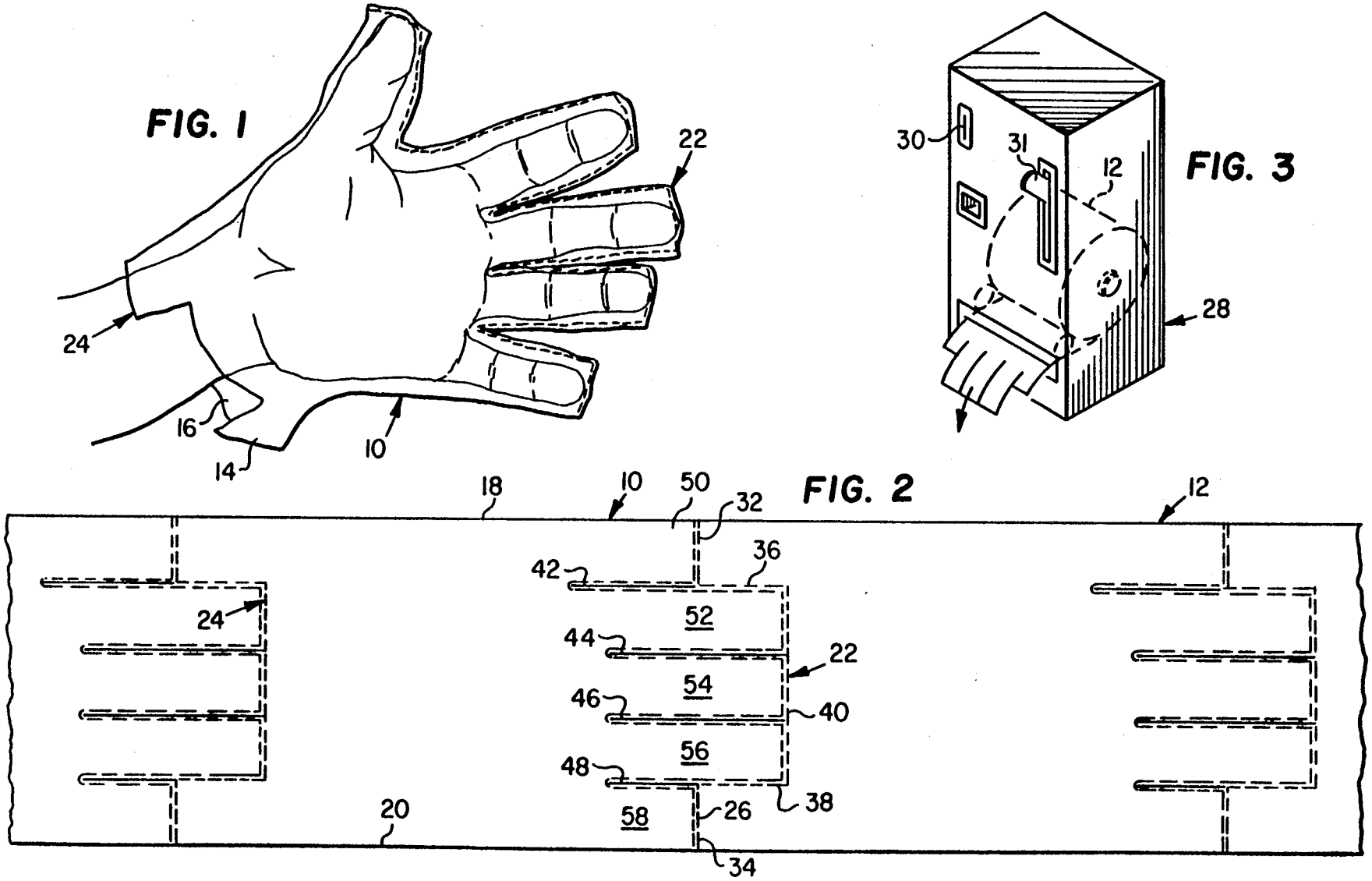
FIG. 1 is a perspective view of a glove formed in accordance with the teachings of the present invention on the hand of the user.
FIG. 2 is a plan view of a glove roll constructed in accordance with the teachings of the present invention.
FIG. 3 is a schematic view of a dispensing machine for dispensing individual gloves from the glove roll.

With reference now to the FIGURES, wherein like reference numerals designate like or corresponding parts throughout the several views, and in particular to FIGS. 1 and 2, a glove 10 is disclosed which forms a portion of a continuous glove roll 12 specifically adapted for dispensing from a dispensing device.

More particularly, the individual gloves 10 are typically formed of a first side 14 and a second side 16 of identical configuration, preferably the material of sides 14 and 16 is a thermoplastic, such as polyethylene.

The sides 14 and 16 are joined along parallel edges 18 and 20 and at a first end 22. At the opposite end 24, the sides are left unsecured to define an opening to insert a hand within the glove, as seen in FIG. 1.

As can best be seen in FIG. 2, a continuous roll of gloves 12 can be manufactured simultaneously with the individual gloves 10 secured end to end along detachable juncture 26. Juncture 26 can be a thin area which is readily separable or can be an area having a line of perforations to again facilitate separation. It can be understood that the roll of gloves 12 is particularly suitable for incremental distribution as by a dispensing machine 28 as seen in FIG. 3. Insertion of a coin within slot 30 of the machine and actuation of lever 31 will permit one or more gloves to be dispensed from the machine from the roll 12 within the machine. In roll form, the gloves are flattened to a thickness corresponding generally to the combined thickness of the first and second sides for compactness. Because the gloves are secured end to end, one or more gloves can be dispensed from the roll in an incremental manner from the open end of the roll through the machine.

While the gloves 10 can be formed as mitts, having no individual finger or thumb portions, or having individual index finger and thumb portions with a common mitt for the other three fingers, the preferred embodiment is as shown in FIGS. 1 and 2 which has individual thumb portion 50 and finger portions 52, 54, 56 and 58. The first end 22 can be seen to include a thumb tip portion 32 and a little finger tip portion 34 which each extend inward from an edge 18 or 20 perpendicular the edge for a distance sufficient to correspond to the width of an average thumb and little finger, respectively. The first end 22 further includes finger side portions 36 and 38 which extend from the inner edge of the portions 32 and 34 parallel the edges 18 and 20 and away from the open end. A finger tip portion 40 interconnects the side portions 36 and 38 and again extends perpendicular the edges to define the glove tips for the middle fingers. Individual splits, 42, 44, 46 and 48 are formed in the glove extending away from the first end to separate the individual finger and thumb portions. The first and second sides are bonded together on opposite sides of the splits and about the end of the split to ensure a fluid-tight glove.

In one glove constructed in accordance with the teachings of the present invention, the distance from edge 18 to edge 20 was selected to be 7½ inches. The width of the individual finger and thumb portions 50–58 was 1½ inches. The distance from portion 40 to portions 32 and 34 was 2 inches and the length of splits 44–46 was 4 inches from the finger tip portion 40. Split 42 was 3 inches long while split 48 was 2 inches long.

Thus, the glove of the present invention, and the roll of gloves resulting from the manufacture of the individual gloves in series, provides a significant advantage to use within a dispensing machine for use at a filling station or the like. Clearly, other uses can be contemplated, including a supply of gloves at a grocery store near the vegetable bins so that people can handle the vegetables without coming into direct contact, a health problem which may receive great attention in the coming days. Even if a machine distributes one or a pair of gloves without the need for input of money, but simply actuation of the lever or other mechanism, this would prevent the type of vandalism common if an open container of gloves is positioned near a gas pump or vegetable bin because the vandal would have to crank the lever multiple times rather than simply taking the whole tray.

While one embodiment of the present invention has been described in detail herein and shown in the accompanying Drawings, it will be evident that various further modifications or substitutions of parts and elements are possible without departing from the scope and spirit of the invention.

I claim:

1. A glove, comprising:

A first side and a second side joined along parallel edges and at a first end, the side separated at the opposite end to permit insertion of a hand, the glove being a portion of a roll of gloves with the first end of each glove being attached to the opposite end of the adjacent glove, the attached ends meeting perfectly to form a continuous roll of gloves with continuous sides and without waste to be removed prior to using the glove, the edges defining the size of the glove roll (The glove of claim 1), the glove further being split along a line parallel to and proximate a first edge from the first end with the first and second sides being joined on either side of the split for a sufficient distance to form a thumb portion.

2. The glove of claim 1 wherein the glove further is split along lines parallel the edges from the first end with the first and second sides being joined on either side of the splits for a sufficient distance to form individual finger portions.

3. The glove of claim 2 wherein the first end includes thumb and little finger tip portions extending inwardly from the parallel edges perpendicular the edges for a distance sufficient to correspond to the width of an average thumb and little finger, respectively, said first end further having side finger portions extending from the inner ends of the thumb and little finger tip portions parallel the edges away from the open end and a finger tip portion connecting the finger side portions extending perpendicular the edges.

4. A mechanism for dispensing gloves, comprising:

A roll of gloves, each roll including individual gloves secured end to end to form the roll, each of said gloves having a first side and a second side joined along parallel edges and at a first end, the side separated at the opposite end to insert a hand, the sides of the roll being defined by the parallel edges of the gloves, each glove secured at its first end to the opposite end of the adjacent glove, with the first end mating perfectly with the adjacent opposite end and leaving no gaps across the width of the roll, each glove being split along a line parallel to and proximate a first edge from the first end with the first and second sides being joined on either side of the split for a sufficient distance to form a thumb portion, with the sides of the roll being continuous and uninterrupted, the joint further creating no waste to be removed prior to use of the glove; and means for dispensing a pre-selected number of said gloves from the roll.

* * * * *